US006591523B2

(12) United States Patent
Pines

(10) Patent No.: US 6,591,523 B2
(45) Date of Patent: Jul. 15, 2003

(54) ACOUSTIC CARD

(75) Inventor: Benjamin A. Pines, Rosly Heights, NY (US)

(73) Assignee: Apple Corporate Technologies, Inc., Floral Park, NY (US)

( * ) Notice: Subject to any disclaimer, the term of this patent is extended or adjusted under 35 U.S.C. 154(b) by 0 days.

(21) Appl. No.: 09/871,703

(22) Filed: Jun. 4, 2001

(65) Prior Publication Data

US 2002/0139017 A1 Oct. 3, 2002

(51) Int. Cl.[7] ..... G09F 1/00
(52) U.S. Cl. ..... 40/124.03
(58) Field of Search ..... 40/124.03, 455, 40/717, 906; 340/384.1

(56) References Cited

U.S. PATENT DOCUMENTS

| | | | | | |
|---|---|---|---|---|---|
| 3,798,806 | A | * | 3/1974 | Sanford | 40/124.03 |
| 3,928,928 | A | * | 12/1975 | Kalust | 40/124.03 |
| 4,102,067 | A | * | 7/1978 | Tarrant | 40/455 |
| 4,288,767 | A | | 9/1981 | Lee | |
| 4,434,567 | A | * | 3/1984 | LeVeau | 206/473 |
| 4,611,262 | A | | 9/1986 | Galloway et al. | |
| 4,618,823 | A | | 10/1986 | Dahlheimer et al. | |
| 4,703,573 | A | * | 11/1987 | Montgomery et al. | 40/124.03 |
| 4,861,505 | A | * | 8/1989 | Farman | 206/77.1 |
| 4,910,634 | A | | 3/1990 | Pipkorn | |
| 5,063,698 | A | | 11/1991 | Johnson et al. | |
| 5,254,879 | A | | 10/1993 | Jackson | |
| 5,275,285 | A | | 1/1994 | Clegg | |
| 5,311,168 | A | * | 5/1994 | Pease et al. | 200/61.93 |
| 5,552,774 | A | | 9/1996 | Gridley | |
| 5,576,678 | A | * | 11/1996 | Saunders | 335/205 |
| 5,639,093 | A | * | 6/1997 | Law et al. | 273/140 |
| 5,761,836 | A | * | 6/1998 | Dawson | 283/117 |
| 5,778,574 | A | * | 7/1998 | Reuben | 40/124.03 |
| 5,864,288 | A | * | 1/1999 | Hogan | 340/332 |
| 6,104,306 | A | * | 8/2000 | Hogue et al. | 200/332 |
| 6,118,986 | A | * | 9/2000 | Harris et al. | 235/441 |
| 6,212,052 | B1 | | 4/2001 | Heuer et al. | |
| 6,314,183 | B1 | * | 11/2001 | Pehrsson et al. | 379/433.06 |

* cited by examiner

*Primary Examiner*—William L. Miller
(74) *Attorney, Agent, or Firm*—Robert E. Bushnell, Esq.

(57) ABSTRACT

An acoustic card having a permanent magnet and a reed switch. The acoustic card includes a first flap, a second flap, and a sound generator attached to second flap. The acoustic card is divided by a fold into two halves, such as the first flap and the second flap, is unfolded in an opened position and folded in a closed position. The sound generator attached to the second flap includes a printed circuit board, a sound card containing a controller and a memory storing audio sound data, and a reed switch. A permanent magnet attached to the first flap does not directly contact the reed switch attached to the second flap. The permanent magnet moves away from the reed switch which then closed electrically to activate the sound generator to produce audio sound, and moves towards the reed switch which then opens electrically to deactivate the sound generator to turn off the audio sound.

11 Claims, 3 Drawing Sheets

ACOUSTIC CARD

BACKGROUND OF THE INVENTION

1. Field of the Invention

The present invention generally relates to sound generating novelty greeting cards and processes, and more particularly, to a process and circuit for controlling operation of the sound generator carried by greeting cards.

2. Description of the Background Art

Business cards having various types and configurations of sound generators are still not that well known, and remain a novelty item. Typically, the sound generator is attached to the inside of a folded card such as a greeting card, an announcement or a business card. Usually, the card includes a sound emitting device and a switch that activates the sound emitting device. The switch is provided with a pair of contacts that are held electrically open by a tongue mechanism that is positioned between the contacts of the switch. When the business card is in an open position, movement of the tongue mechanism during the opening of the card allows the contacts of the switch to close in order to electrically activate the sound emitting device to produce audio sound. If the business card is in a closed position however, the contacts of the switch are held apart by the tongue so that the switch remains in an electrically open state to deactivate the sound emitting device and thereby stop the production of audio sound.

Almost all acoustic cards are folded into two or more surfaces, with a sound generator, battery and speaker mounted on one of the interior surfaces, and an actuator that spans the fold of between the two adjoining surfaces. Some of these acoustic cards are physically bulky and their actuator tends to become deformed and intermittently inoperable as a result of repeated use. Other models of acoustic cards use electrical actuators that depend upon a tongue that is made of an electrically insulating material, and is connected to an audio sound generator mounted on one side of the card and attached to the surface of the card on the opposite side of the fold. The presence of the sound generator is therefore concealed while the card is folded into a closed position. Consequently, rough handling, such as an opening of the card by rotating the two planar interior surfaces more than one hundred and eighty degrees around the fold, may destroy the connection of the actuator, frequently allowing the card to become a nuisance by broadcasting sound continuously, even after the interior surfaces have been closed, until the battery has been drained.

Since the contacts of the switch mechanically contact the tongue mechanism, misplacement and distortion of the tongue mechanism will usually cause a malfunction of both the switch and the sound emitting device when the business card is moved from its open position to its closed position. Moreover, the presence of foreign material between the tongue mechanism and the contacts of the switch, or abrasion of the tongue mechanism and the contacts of the switch, will cause the contacts of the switch to be abruptly opened to interrupt the operation of the sound emitting device or to unexpectedly close to allow the sound emitting device to produce audio sound when a user does not want the audio sound. Such unpredictable operation of the sound emitting device destroys the utility of the card long before expiration of the life of the battery that powers the audio generator, and tends to diminish the novelty and merchantability of acoustic cards.

Recent efforts to improve the design of the switch and tongue mechanism have improved the reliability of the acoustic card, but have introduced complexity into the structure of the acoustic card with a concomitant difficulty in manufacture.

SUMMARY OF THE INVENTION

It is an object of the present invention to provide an improved acoustic card and process for operating an acoustic card.

It is another object to enhance the durability of an acoustic card equipped with a sound generator.

It is still another object to provide an improved acoustic card that is less susceptible to a malfunction by its sound generator.

It is yet another object to provide an acoustic card having an electrical actuator able to avoid abrasion of the contacts of an electrical switch operating the sound generator.

It is still yet another object to provide an acoustic card having a sound generator able to predictably furnish audio sounds throughout the battery life of the card.

It is a further object to provide an acoustic card equipped with a sound generator battery and actuator that is able to repeatedly and predictably broadcast audio sounds during the life of the battery.

It is a still further object to provide a design for an acoustic card that has a simple design, is easy to manufacture, is reliable in operation even after repeated use, and exhibits minimal failure during that use.

It is also an object to provide an acoustic card having a reduced thickness.

These and other objects may be achieved with an acoustic card constructed with a first flap separated by a fold from a second flap, a sound generator mounted on a circuit board driving a speaker, and a battery that powers the sound generator, and an actuator incorporating a reed switch attached to the second flap. The first flap and the second flap are mutually rotatable about the fold. A permanent magnet may be mounted on a distal end of a movable tongue, with the proximal end of the tongue attached to the first flap and the distal end of the tongue slidably received within a recess in the circuit board, to place the magnet in operational proximity to the reed switch. The proximal end of the tongue is attached to the first flap at a location selected to place the magnet in sufficient proximity to the reed switch to cause the electrical contacts of the reed switch to switch between an electrically open state and an electrically closed state when rotation of the first flap relative to the second flap either places the magnet adjacent to the electrical contacts or moves the magnet away from proximity to the electrical contacts, to enable the electrical contacts of the reed switch to be closed to activate the sound generator to produce audio sound, or to be in an electrical open state to deactivate the sound generator and terminate the audio sound. The permanent magnet may be positioned to move close to a side of, but not beneath the reed switch so that the thickness of the acoustic card is reduced.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
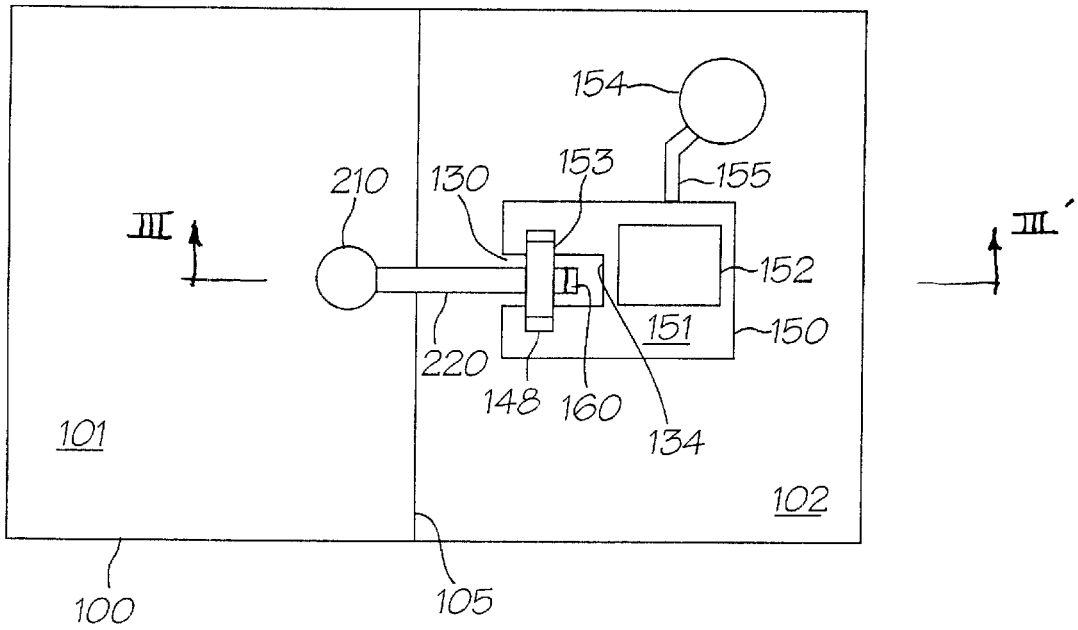
FIG. 1 is a plan view of an acoustic card constructed according to the principles of the present invention.
Figure 2:
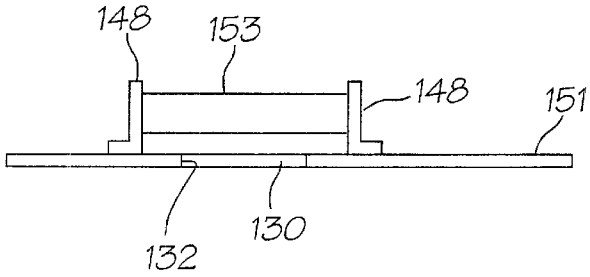
FIG. 2 is an end elevational view of the circuit board shown in FIG. 1 in an open position.
Figure 3:
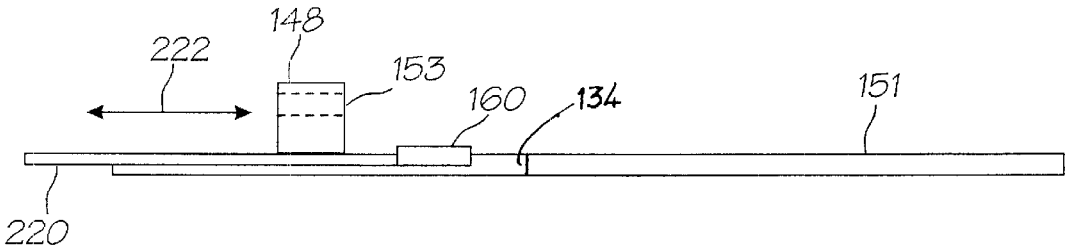
FIG. 3 is a side elevational view of the circuit board taken along sectional line III–III' shown in FIG. 1.
Figure 4:
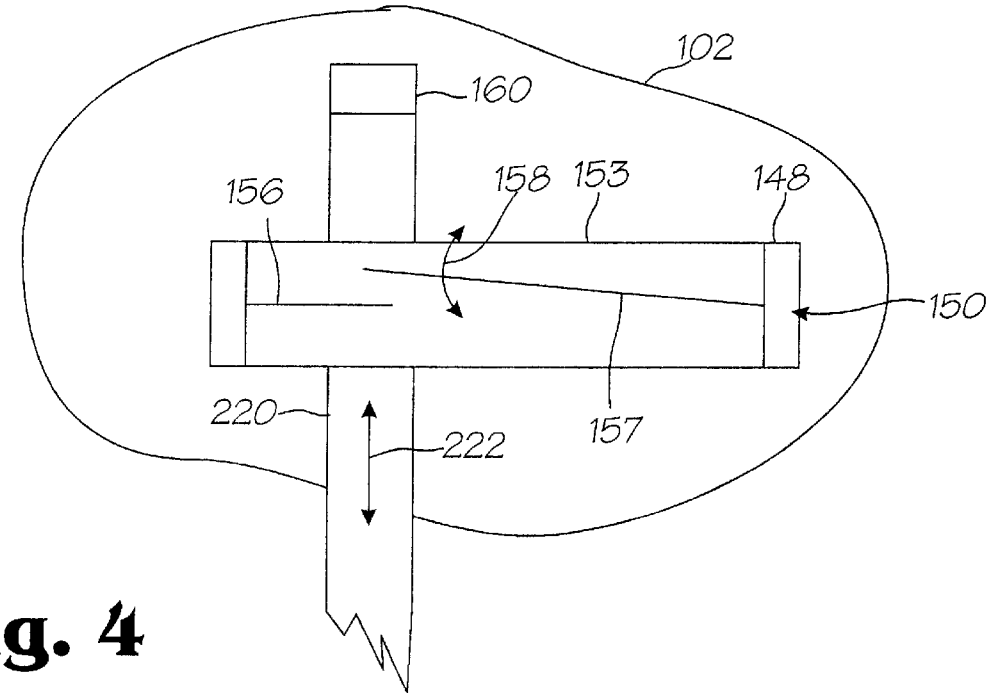
FIG. 4 is a partial plan view showing the movement by a reed of a reed switch in response to movement of a magnet incorporated into the embodiment illustrated by FIG. 1.

Turning now to the drawings, FIG. 1 illustrates an opened acoustic card 100 having a first flap 101, a second flap 102, and a printed circuit board sound generator 150 attached to second flap 102. Acoustic card 100 may be divided by a fold 105 into two approximately equal planar surfaces, such as first flap 101 and second flap 102, and alternately manipulated into an unfolded state while the flaps 101, 102 are in an open position and, referring temporarily to FIG. 5, into a folded state while flaps 101, 102 are in a closed position. Sound generator 150, which may be constructed as a sound module, includes a printed circuit board (printed circuit board) 151, a sound card 152 that is mounted on printed circuit board 151 contains a controller and a memory, such as a read only memory that stores audio sound data. Alternatively, the audio sound data may be stored in binary form, and applied by the controller to a digital to analog converter driving audio speaker 154 at frequencies that reproduce the original audio data. Reed switch 153 is mounted on printed circuit board 151 and coupled to sound generator 152, and speaker 154 is coupled to printed circuit board 151 through electrical leads 155. In response to the open and closed states of reed switch 153 that are triggered by movement of magnet 160 relative to the internal spring biased electrical contacts 156, 157 of reed switch 153 to move along arrow 158 relative to one another as shown in FIG. 4. Sound card 152 is powered by a dry cell electrical battery that is also mounted on circuit board 151, to reproduce the audio sound by using the audio sound data stored in the memory to drive speaker 154 in conformity with that audio sound data, and is deactivated in response to the opposite movement of magnet 160 to terminate reproduction of the audio sound through speaker 154.

Figure 5:
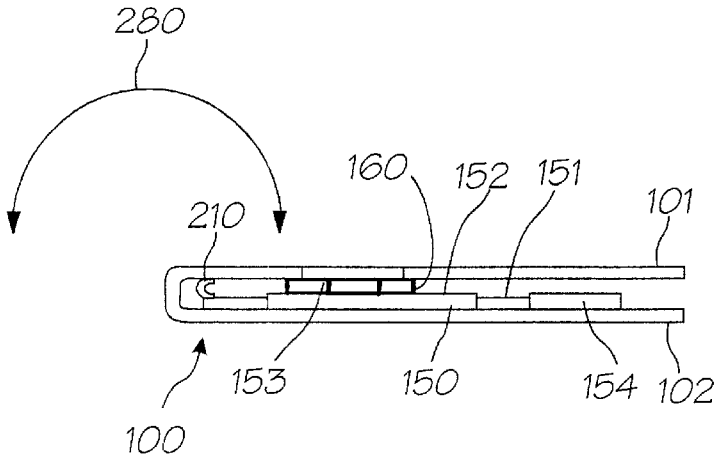
FIG. 5 is a side elevational view of an acoustic card folded into the closed position.

The proximal end of magnet 160 is attached to first flap 101 by a flexible coupler 210 that may be joined with adhesive to first flap 101 at a particular location where magnet 160 will be positioned adjacent to reed switch 153 when acoustic card 100 is folded into the opened position as shown by FIG. 1. If acoustic card 100 is unfolded into its open position, magnet 160 is drawn by tongue 220 towards reed switch 153, and then the internal spring biased electrical contacts 156, 157 of reed switch 153 are closed by the magnetic field of magnet 160 to enable the flow of electrical energy from the battery to activate sound card 152, thereby producing audio sounds through speaker 154. When acoustic card 100 is folded into the closed position as shown by FIG. 5, magnet 160 moves farther away from reed switch 153, and the resultant weakening of the magnetic field allows the spring bias of contact 157 to open (i.e., to electrically separate from contacts 156, 157) the internal electrical contacts of reed switch 153 and to deactivate sound card 152 to stop the reproduction of the audio sound through speaker 154. These audio sounds may alternatively be produced for a predetermined period of time regardless of whether card 100 is folded or unfolded, once reed switch 153 has initially been placed in a closed electrical state to activate sound card 152 by an initial unfolding of acoustic card 100 into its open position.

Referring now to FIGS. 1, 2, 3, 4 and 5 collectively, a slot 130 is formed into the end of circuit board 151 that faces first flap 100. Coupler 210 positions the proximal end of tongue 220 on first flap 101 at a short distance across fold 105 from slot 130. A pair of end brackets 148 that are surface mounted on circuit board 151 on opposite sides of slot 130 hold longitudinally axial opposite ends of reed switch 153 across slot 130, thereby allowing tongue 220 to easily slide beneath electrical contacts 156, 157 without the necessity for either tongue 220 or magnet 160 to make a direct physical contact with reed switch 153.

End brackets 148 may raise the cental portion of the body of reed switch 153 above the plane defined by the upper surface of circuit board 151 so as to give tongue 220 sufficient height to slide beneath reed switch 153 as flaps 101, 102 rotate through arrow 280 and to accommodate a moderate amount of lifting of the proximal end of tongue 220 by coupler 210 as first flap 101 is raised above the plane of second flap 102. It is not necessary for tongue 220 to draw magnet 153 directly beneath electrical contacts 156, 157 of reed switch 153 in order to change the electrical state of reed switch 153; it is only necessary for tongue 220 to move magnet 160 along arrow 222 between a first position, shown by FIG. 1 where the force of the magnetic field created by stationary permanent magnet 160 draws contacts 156, 157 together and a second position, shown by FIGS. 4 and 5 where that force is too weak to overcome the spring bias of contact 157. When first flap 101 is rotated about arrow 280 to overlie second flap 102, the fixed position of coupler 210 relative to first flap 101 forces tongue 220 and magnet 160 mounted on the distal end of tongue 220 along arrow 222 toward the closed end wall 134 of slot 130, thereby allowing contacts 156, 157 to assume their electrically open positions shown by FIG. 4.

Although speaker 154 is connected to printed circuit board 151 through electrical leads 155, speaker 154 may be installed on printed circuit board 151. Reed switch 153 is connected to sound card 152 and a battery that may be mounted on printed circuit board 151.

Permanent magnet 160 does not need to directly contact the surface of reed switch 153. Normally, electrical contacts 156, 157 are protectively encased within the vacuum of a glass, or plastic shell of reed switch 153. Permanent magnet 160 is disposed adjacent to reed switch 153 at a place where the reed of reed switch 153 is opened and closed by the magnetic field generated by magnet 160.

When permanent magnetic 160 is moved toward the side of reed switch 153 by manually unfolding first and second flaps 101, 102 of acoustic card 100 into its open position, reed 157 of reed switch 153 moves in the direction 158 parallel to the surface of second flap 102 to close reed switch 153. When permanent magnet 160 is moved toward the corresponding position toward end wall 134 by folding the first and second flaps 101, 102 of acoustic card 100 into the closed position, electrical reed contact 157 of reed switch 153 moves in the direction 158 perpendicular to the fold 105 between first and second flaps 101, 102 to open reed switch 153.

When first and second flaps 101, 102 of acoustic card 100 are folded in mutually positions, permanent magnet 160 is spaced apart from reed switch 153 by a first predetermined distance where reed 157 of reed switch 153 is located outside the magnetic field of permanent magnet 160.

Subsequently, when first and second flaps 102, 102 of acoustic card 100 are unfolded into their open positions, permanent magnet 160 moves toward reed switch 153 by a second predetermined distance where reed 157 of reed switch 153 is located within the magnetic field of permanent magnet 230. In any case of unfolding and folding first and second flaps 101, 102 of acoustic card 100 into the open position and the closed position, permanent magnet 160 does not need to directly contact reed 157 of reed switch 153.

As mentioned above, with the acoustic card having a permanent magnet and a reed switch constructed according to the principles of the present invention, the acoustic card is durable and prevented from malfunction caused by distortion and abrasion of the acoustic card since no direct contact is made between the permanent magnet and the reed of the reed switch. Moreover, since the permanent magnet moves along the side of reed switch, the thickness of the acoustic card can be reduced. The expedient of modifying the shape of the printed circuit board 151 to provide slot 130 formed as an integral part of the single monolithic unified structure of circuit board 151 readily allows the incorporation of a reed switch into the circuit while enhancing the reliability of the structure and simplifying the overall design and compactness of the acoustic card without requiring additional component parts. Slot 130 provides a simple guide for the longitudinal travel of tongue 220 and permanent magnet 160 without the necessity for ancillary or peripheral structural elements to assure correct travel of magnet while maintaining operational alignment of magnet 153 with reed switch 153 during the lifetime of repeated opening and closing of card 100.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. An acoustic card, comprising:

a first flap and a second flap joined together along a fold that accommodates rotation of the first flap relative to the second flap as said first and second flaps rotate along said fold between alternate orientations of folded in a closed position and unfolded in an open position;

a circuit board attached to said second flap, and bearing an incised slot oriented toward said first flap;

an elongate tongue having a proximal end flexibly attached to said first flap and a longitudinally opposite distal end carrying a magnet slidably received within said slot;

an electrically powered sound generator mounted upon said circuit board;

a speaker driven by said sound generator to broadcast audio messages; and a reed switch mounted on said circuit board in operational proximity to said slot, to respond to travel of said magnet along said slot by enabling activation of said sound generator to drive said speaker.

2. The acoustic card of claim 1, further comprised of said reed switch being mounted upon opposite sides of said circuit board with an intermediate section of said reed switch spanning said slot.

3. The acoustic card of claim 1, further comprised of said reed switch having a plurality of electrical contacts controlling said activation by exhibiting relative movement in response to said travel of said magnet in a direction parallel to said travel of said magnet.

4. The acoustic card of claim 1, further comprised of said reed switch exhibiting a longitudinal axis, and said tongue moving in a direction parallel to said longitudinal axis when said first flap and second flap rotate around said fold and move between the closed position and the open position.

5. The acoustic card of claim 4, with said magnet moving toward and away from said reed switch as said tongue moves in response to movement of said first flap with respect to said second flap around said fold.

6. The acoustic card of claim 1, with said magnet spaced inoperatively apart from said reed switch when said first flap and said second flap are said folded in a closed position.

7. The acoustic card of claim 1, with said magnet disposed in operational proximity to said reed switch while said first flap and said second flap are said unfolded in an open position, with said first flap and said second flap approximately defining a continuous single planar surface and wherein said magnet is spaced inoperatively apart from said reed switch while said first flap and said second flap are said folded in a closed position.

8. A greeting process, comprising the steps of:

joining a first flap and a second flap of an acoustic card together rotationally along a fold of said acoustic card allowing orientations of folded in a closed position and unfolded in an open position;

providing a circuit board attached to said second flap, with an incised slot formed in said circuit board oriented toward said first flap;

attaching a proximal end of an elongate tongue flexibly to said first flap and a longitudinally opposite distal end of said elongate tongue bearing a magnet slidably received within said incised slot;

attaching a sound generator upon said circuit board;

attaching a speaker driven by said sound generator to broadcast audio messages;

providing a reed switch on said circuit board;

moving said acoustic card to said closed position when turning off said audio messages;

moving said acoustic card to said open position when producing said audio messages;

moving said magnet toward said reed switch when said acoustic card is in said open position; and moving said magnet away from said reed switch when said acoustic card is in said closed position.

9. The process of claim 8, further comprising the step of operating said reed switch by moving a reed of said reed switch in a direction perpendicular to said fold.

10. An acoustic card, comprising:

a first flap and a second flap joined together along a fold that accommodates rotation of said first flap with respect to said second flap;

a circuit board attached to one of said first and second flaps, bearing an incised slot oriented toward the other flap of said first and second flaps;

an elongate tongue having a proximal end flexibly attached to said other flap of said first and second flaps, and said elongate tongue having an opposite distal end comprising a magnet slidingly receivable within said incised slot, an electrically powered sound generator on said circuit board, a speaker driven by said sound generator to broadcast audio messages; and a reed switch on said circuit board in operational proximity to said incised slot;

whereby travel of said magnet within said slot towards said reed switch activates said reed switch when said magnet enters an operational area surrounding said reed switch.

11. The acoustic card of claim 10, returning said reed switch to a normal position of said reed switch by moving said magnet from said operational area surrounding said reed switch.

* * * * *